US006414402B1

(12) United States Patent
Lutz

(10) Patent No.: US 6,414,402 B1
(45) Date of Patent: Jul. 2, 2002

(54) MOTOR VEHICLE STARTER MONITORING SYSTEM WITH AUTOMATIC CONTROL UNIT ACTIVATION

(75) Inventor: Steffen Lutz, Karlsfeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/522,395

(22) Filed: Mar. 9, 2000

(30) Foreign Application Priority Data

Mar. 9, 1999 (DE) ..... 199 10 330

(51) Int. Cl.[7] ..... F02P 9/00
(52) U.S. Cl. ..... 307/10.6
(58) Field of Search ..... 307/10.3, 10.6

(56) References Cited

U.S. PATENT DOCUMENTS 4,883,973 A * 11/1989 Lakey et al. ..... 290/31
5,175,439 A * 12/1992 Harer et al. ..... 307/10.1
5,929,537 A * 7/1999 Glennon ..... 307/46
5,998,976 A * 12/1999 Steffan ..... 307/10.6
6,134,875 A * 10/2000 Massey ..... 60/39.142
6,304,056 B1 * 10/2001 Gale et al. ..... 320/104

FOREIGN PATENT DOCUMENTS

DE 195 32 163 3/1997 ..... F16F/15/18

* cited by examiner

*Primary Examiner*—Jeffrey Sterrett
(74) *Attorney, Agent, or Firm*—Crowell & Moring LLP

(57) ABSTRACT

A system for monitoring a starter unit in a motor vehicle is provided. The vehicle is equipped with an electrical machine serving as both a starter and a generator, an inverter for converting the current generated or required in the electrical machine, and a control unit for controlling the operation of the unit consisting of the electrical machine and the inverter as a function of input signals. The control unit is capable of being activated at intervals even when the vehicle is not operating. An additional control function is provided to activate or deactivate the inverter as a function of vehicle operating information. As a result, unintentional movement of the vehicle is prevented during automatically occurring activation periods of the control system.

8 Claims, 2 Drawing Sheets

MOTOR VEHICLE STARTER MONITORING SYSTEM WITH AUTOMATIC CONTROL UNIT ACTIVATION

BACKGROUND AND SUMMARY OF THE INVENTION

This application claims the priority of German Application No. 199 10 330.5, filed Mar. 9, 1999, the disclosure of which is expressly incorporated by reference herein.

The invention relates to a system for monitoring a starter unit of a vehicle equipped with an asynchronous electrical machine serving as a starter and a generator, an inverter for converting the current generated or required in the electrical machine, and a control unit for controlling the operation of the unit consisting of the electrical machine and the inverter as a function of input signals. The control unit is capable of being activated at intervals also when the vehicle is not operated.

In the case of starter units for internal-combustion engines, the driver's intention to start, as a rule, is reported to the starter unit by the closing of an electric contact, such as a switch. To avoid unintended movement of the vehicle, systems are known which permit starting only when, for example, the clutch pedal is depressed. In this context and with respect to related subjects, reference is made to International Patent Document WO 94/15808 and Japanese Patent Document JP 09042005 A. In these publications, systems are described which prevent an unintended driving-away in that they allow an engine start only under defined vehicle operating conditions, such as the operation of a clutch pedal.

In contrast, the present invention is aimed at a newer type of starter units for motor vehicles. In the case of these starter units, electrical machines are used which are operated as starters as well as generators. As an example, reference is made to crankshaft starter generators which have become known in the meantime. These electrical machines are connected by way of an inverter with an electricity supply system, to which consuming devices and batteries are, in turn, connected. For example, an electric valve gear may be provided as a consuming device. The electric valve gear has to be operated in an operationally reliable manner already during the starting operation. In the case of such an electric valve gear, but also in the case of other consuming devices, sufficient electric energy must already be provided during the starting operation. A control unit is used for this purpose. The control unit can be activated at certain intervals, also when the vehicle is not in operation, and tests the electrical condition of the vehicle power supply. However, during such an automatically occurring activation of the control unit, it must be completely excluded that the electric machine used as the starter is operated unintentionally and causes the movement of the vehicle, for example, when a gear is engaged.

It is therefore an object of the present invention to further develop a system of the above-mentioned type such that unintentional movement is excluded.

This object is achieved by a system for monitoring a starter unit in a motor vehicle equipped with an electrical machine serving as both a starter and generator, an inverter for converting the current generated or required in the electrical machine, and a control unit for controlling the operation of the unit consisting of the electrical machine and the inverter as a function of input signals. The control unit is also capable of being activated at intervals when the vehicle is not operating. An additional control function is provided, which activates or deactivates the inverter as a function of vehicle operating information.

Accordingly, an additional control is provided which activates or deactivates the inverter as a function of vehicle operating information. The linkage of the vehicle operating information as well as the release or blocking of the inverter can take place by way of software. However, the greatest safety is provided by a hardware circuit in the form of a driver. The inverter, which establishes the connection between the vehicle power supply and the electrical machine, will therefore only be activated if this is permitted by the vehicle operating information.

A rotational speed signal of the engine and a clutch operating signal may, for example, be used as vehicle operating information. In this case, the additional control is constructed such that the inverter is set to active only when either the clutch is operated or the rotational speed exceeds a defined value. This embodiment ensures that the electric machine, which becomes operative as the starter, can be started only when the clutch pedal is completely depressed. In addition, a continued operation of the electric machine is also possible without a clutch operation when a defined rotational speed of the engine has been reached or exceeded.

Naturally, instead of the clutch operating signal, other signals may also be used, such as a P/N signal of an automatic transmission. The signal must only ensure that the transmission line of the vehicle is interrupted so that, during the starting, a moving of the vehicle is prevented in every case.

Other objects, advantages and novel features of the present invention will become apparent from the following detailed description of the invention when considered in conjunction with the accompanying drawings.

DETAILED DESCRIPTION OF THE DRAWINGS

Figure 1:
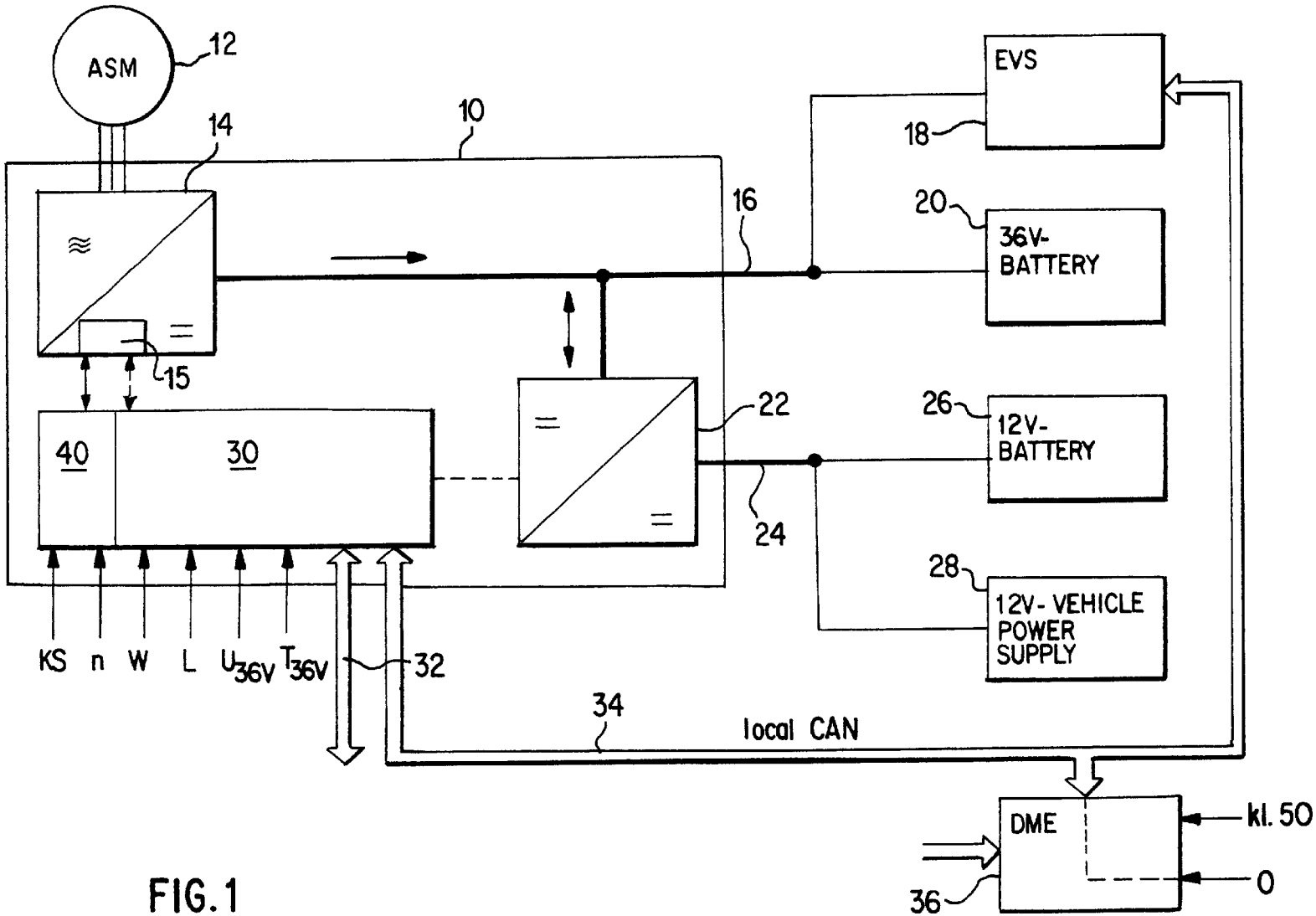
FIG. 1 is a schematic block diagram of a starter unit with consuming devices according to the present invention.

FIG. 1 is a schematic view of a starter unit with a control unit 10, which comprises an inverter 14, a DC converter 22, a central unit 30 and an additional control 40. The inverter 14 is connected with an asynchronous electrical machine 12, which can be operated as a starter as well as a generator. The current supplied by the asynchronous machine 12 in the generator operation or the current required by this asynchronous machine 12 in the starter operation is converted by way of the inverter 14 to a direct current and fed into a vehicle power supply or taken from this power supply.

In the present case, the vehicle power supply consists of a power source with a power voltage of 42 V, which is in a direct contact with a 36 V battery 20 as well as a consuming device. In the present case, this consuming device is an electric valve gear 18.

In addition, a 12 V vehicle power supply 24 is provided which is supplied by the 42 V power supply by way of the DC converter 22. In the present case, a 12 V battery 26 as well as other consuming devices 28 are connected to the 12 V power supply 24.

By way of a local CAN bus 34, the central unit 30 and the electronic valve gear 18 are connected with digital engine electronics DME 36. The digital engine electronics 36 are also connected with another CAN bus system and also receive signals from the terminal 50 as well as from a diagnostic line D.

The central computer unit 30 receives its commands from the digital engine electronics 36. In addition, information is read in by way of the CAN bus 32. Additional input information of the central computer unit 30 consists of a prompting signal W, a charge signal L, a voltage signal of the 36 V battery $U_{36\ V}$ as well as a temperature signal of the 36 V battery $T_{36\ V}$.

The central control 30 acts upon the inverter 14, more precisely, a driver circuit 15 of the inverter 14, and causes an operation of the asynchronous machine 12, which is required according to the input quantities.

By way of the prompting signal W, the central control 30 is temporarily automatically activated (prompted) also when a vehicle is not in operation.

As an alternative, the prompting signal W can also be generated within the central control 30.

The prompting signal W has the following purpose: As early as during a start, the electric valves gears must be supplied with electric current in an operationally reliable manner. For this purpose, the required power must be available as early as during the start. Also, when the vehicle is parked, the central computer unit 30 now checks the 42 V vehicle power supply voltage at defined intervals in order to detect whether the power/voltage required for the case of a start can be provided by the 36 V battery 20. If this is not so, the 36 V battery 20 will be charged from the 12 V battery 26 by way of the DC converter 22.

However, what must definitely be prevented, in the case of such a prompting operation, is vehicle movement as the result of an operation of the asynchronous machine 12 in the starter mode and when a gear is engaged. In order to prevent this, a separate control 40 is provided which receives the rotational speed signal n of the engine and a clutch signal KS as input signals. Corresponding to these input signal quantities, the control 40 generates a signal and sends this signal to the driver circuit 15 of the inverter 14 which, as a result, is changed into an activated or a deactivated condition.

Figure 2:
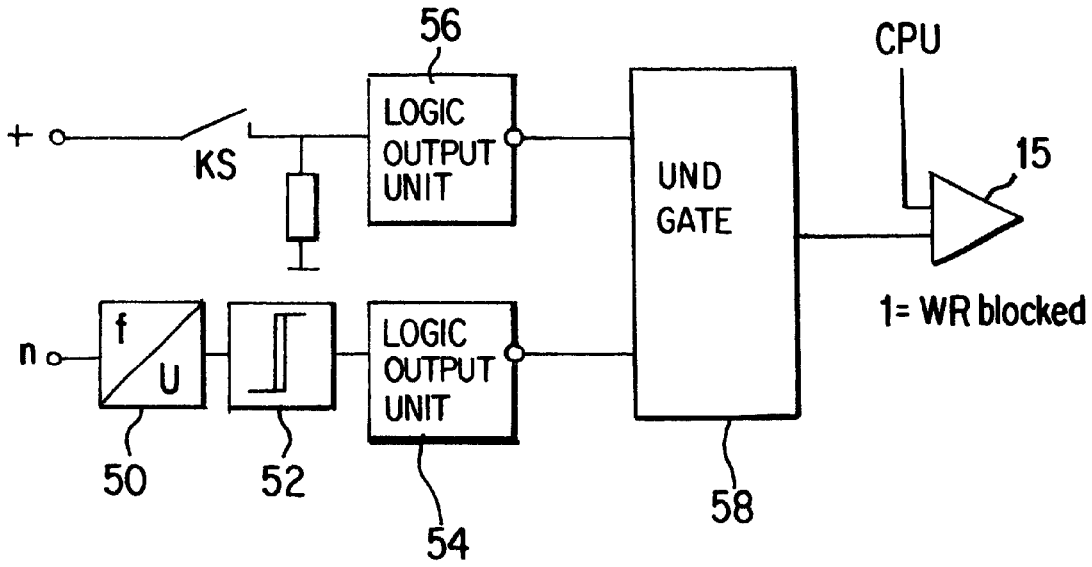
FIG. 2 is a schematic block diagram of a concrete further development of an additional control from FIG. 1 according to the present invention.

One embodiment of the additional control 40 is illustrated in the block diagram of FIG. 2. In a branch of this control, the rotational speed signal n of the engine is converted by way of a frequency-to-voltage converter 50 into a voltage. This voltage is applied to a threshold value comparator 52, which will then generate a signal when the voltage U exceeds a defined value. The resulting signal is converted in a unit 54 into a logical 0/1 signal and is transmitted to an AND gate 58.

In the second branch, the unit 56 converts, corresponding to the operation of the clutch switch KS, the present signal also into a logical 0/1 signal and also transmits it to the AND gate 58.

The AND gate 58 will emit an activating signal to the driver circuit 15 of the inverter 14 only if the clutch is operated and the rotational engine speed n exceeds a defined limit value. In the present case, the inverter 14 will be blocked when a 1 is present at the driver circuit (1=WR→blocked).

By means of this constructive further development, an operation of the electric machine is effectively prevented when the central computer unit 30 is automatically activated by means of the prompting signal W. An operation of the asynchronous machine 12 from a parked position can therefore take place only when the clutch switch is operated. Only when the rotational engine speed has exceeded a defined threshold value can the asynchronous machine continue to operate also without the operation of the clutch switch.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for monitoring a starter unit in a motor vehicle, comprising:

an electrical machine serving as a starter and a generator;

an inverter coupled with the electrical machine, said inverter converting current generated or required in the electrical machine;

a control unit operatively coupled to control a unit formed of the electrical machine and the inverter as a function of input signals, said control unit being automatically activatable at intervals even when the vehicle is not operating;

an additional control operatively coupled to separately activate or deactivate the inverter as a function of vehicle operating information, whereby operation of the electrical machine is preventable when the control unit is automatically activated.

2. The system according to claim 1, wherein said additional control receives a rotational engine speed signal and a transmission signal as the vehicle operating information, said additional control being constructed to activate the inverter when either a transmission line is interrupted with respect to a torque transmission or the rotational engine speed exceeds a defined value.

3. The system according to claim 2, wherein one of a clutch operating signal and a P/N signal of an automatic transmission is used as the transmission signal.

4. The system according to claim 1, wherein the inverter includes a driver acted upon by the additional control, said driver performing the activation or deactivation of the inverter.

5. The system according to claim 2, wherein the inverter includes a driver acted upon by the additional control, said driver performing the activation or deactivation of the inverter.

6. The system according to claim 3, wherein the inverter includes a driver acted upon by the additional control, said driver performing the activation or deactivation of the inverter.

7. A method of controlling a starter unit in a motor vehicle in which an electrical machine serves as a both a starter and a generator, and an inverter is coupled with the electrical machine for converting current generated or required in the electrical machine, the method comprising the acts of:

receiving at least one of an engine rotational speed signal and a clutch operating signal in a control system; and controlling operation of the electrical machine and the inverter as a function of input signals, even when the vehicle is not operating, wherein:

said inverter is separately activated or deactivated as a function of the at least one engine rotational speed signal and clutch operating signal to prevent unintended movement of the vehicle in cases where the control system is automatically activated at intervals even when the vehicle is not operating.

8. The method according to claim 7, wherein said inverter is activatable when either the clutch operating signal indicates a transmission line of the vehicle is interrupted or the engine rotational speed signal exceeds a defined value.

* * * * *